United States Patent [19]

Lödige et al.

[11] 4,143,975

[45] Mar. 13, 1979

[54] APPARATUS FOR APPLYING ADHESIVE TO FIBROUS MATERIAL

[76] Inventors: Wilhelm Lödige, Elsener Str. 9c; Fritz Lödige, Leuschner Str. 12; Josef Lücke, Im Lohfeld 13, all of 4790 Paderborn; Wilhelm Schlüter, Osttorstr. 9, 4791 Schwaney, all of Fed. Rep. of Germany

[21] Appl. No.: 787,157

[22] Filed: Apr. 13, 1977

Related U.S. Application Data

[63] Continuation of Ser. No. 600,066, Jul. 29, 1975, abandoned.

[30] Foreign Application Priority Data

Aug. 3, 1974 [DE] Fed. Rep. of Germany ..... 2437571

[51] Int. Cl.[2] ..... B01F 7/02; B01F 15/02

[52] U.S. Cl. ..... 366/147; 156/62.2; 156/578; 23/313 R; 366/169; 366/172; 425/200; 425/209

[58] Field of Search ..... 156/578, 62.2, 62.4, 156/500, 501; 425/200, 205, 209, 222; 23/313 R, 314; 259/9, 10, 25, 182; 264/117; 118/19, 303, 323; 366/135, 147, 165, 169, 172, 279, 341

[56] References Cited

U.S. PATENT DOCUMENTS

| | | | |
|---|---|---|---|
| 1,643,392 | 9/1927 | Mullaney | 425/205 X |
| 2,834,044 | 5/1958 | Antonsen et al. | 425/222 |
| 3,020,025 | 2/1962 | O'Mara | 259/9 |
| 3,186,687 | 6/1965 | Askew, Jr. et al. | 425/222 X |
| 3,250,321 | 5/1966 | Root | 259/9 |
| 3,734,471 | 5/1973 | Engels | 259/10 X |
| 4,015,829 | 4/1977 | Förster et al. | 259/9 |

*Primary Examiner*—Michael G. Wityshyn
*Attorney, Agent, or Firm*—Walter Becker

[57] ABSTRACT

An apparatus for applying adhesive to fibrous material in which a generally horizontal cylindrical member is provided having an inlet in the top near one end and an outlet in the bottom near the other end. A shaft is rotatable on the axis of the cylindrical member and has radially extending tools thereon angularly spaced from one another and disposed in a substantially helical path along the shaft. The tools nearest the inlet have a passage means therein through which adhesive is supplied to fibrous material introduced into the inlet while the others of the tools admix the adhesive with the fibrous material.

14 Claims, 17 Drawing Figures

Fig. 3
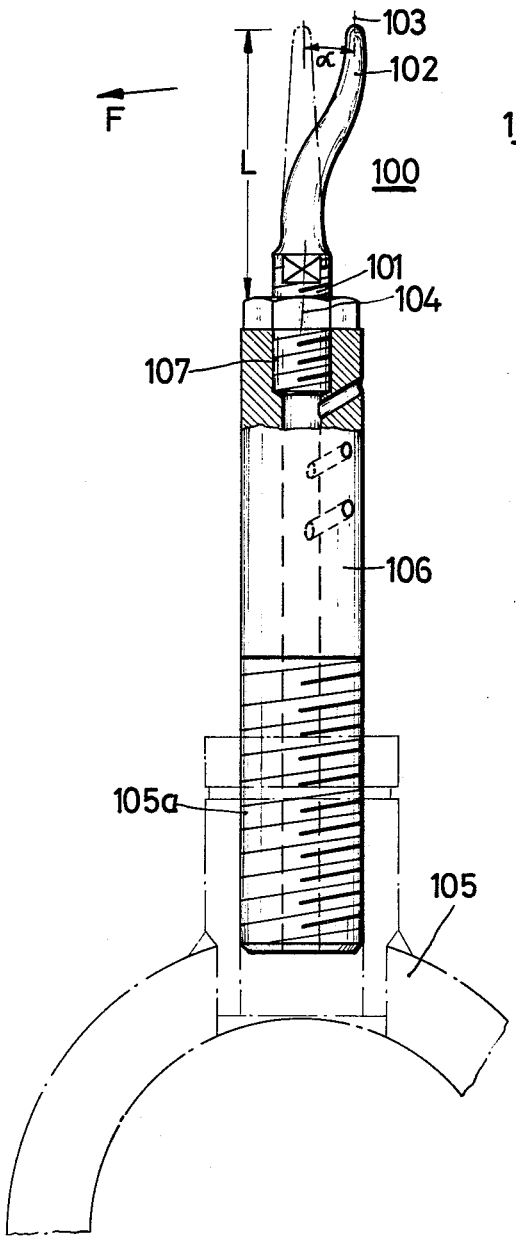
Fig. 4
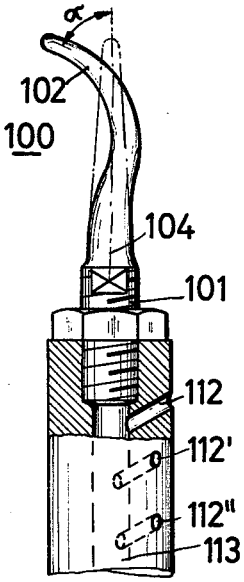
Fig. 5
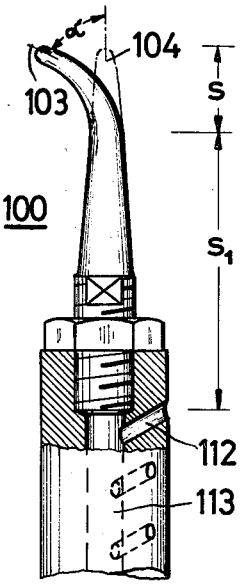
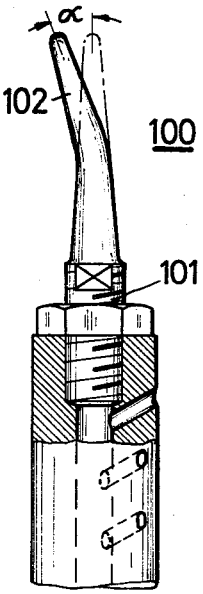
Fig. 6
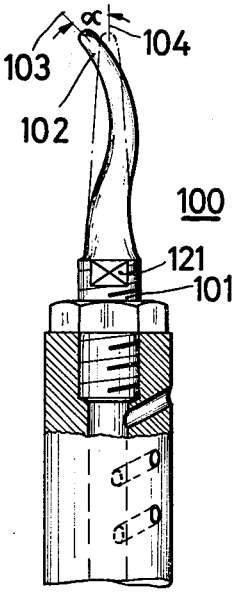
Fig. 7

Fig. 11
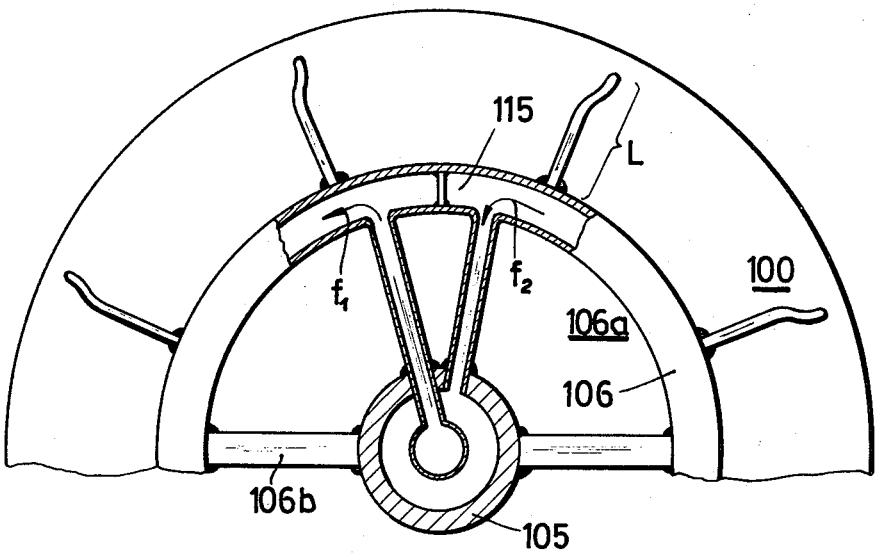
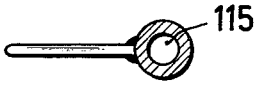
Fig. 11a
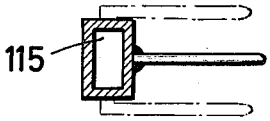
Fig. 11b

APPARATUS FOR APPLYING ADHESIVE TO FIBROUS MATERIAL

This is a continuation of application Ser. No. 600,066, filed July 29, 1975, now abandoned.

The invention relates to a process for the gluing of fibers of materials containing cellulose such as wood, bagasse, or similar materials, in which the fibers are moved along approximately circular paths, while during their rotation glue is applied to them at one section of their path, and in which the mixture of fibers and glue is kept rotating to ensure uniform distribution of the glue under the fibers. The invention also relates to an apparatus particularly suitable for carrying out the process.

Known plants for the gluing of fibers, in which tools rotate on a shaft mounted in a drum-shaped mixing chamber adjacent to the mixing chamber wall, the mixture being passed to these tools after application of the glue, are used for gluing both fibers and chips or similar materials. Such devices are based on the fact that to achieve a homogeneous glue-fiber mixture, it is not so much a very uniform glue distribution on application which is important as much more a rapid homogenization within the mixture rotating on the wall of the mixing chamber in the form of a ring in such a way that the chips or similar materials are moved against one another after glue application under moderate pressure so that the glue initially adhering to the individual particles in varying quantities is spread between the particles by friction between the chips dissolving concentrations of glue deposit between the individual particles. To achieve this spreading effect between the chips in the ring of chips rotating on the wall of the cylindrical mixing chamber the tools inserted into the ring of chip material in the mixing zone adjacent to the gluing zone are generally provided with surfaces inclined in driving direction. These tools when plowing through the mixture apply a moderate pressure to the mixed material and thus press the chip particles against one another without damaging pressure, and with simultaneously produced relative movements between the particles, an intensive spreading of the glue between the particles of the ring of chip material is achieved. When plowing through the mixture, the particles adjacent to the tool slide along the inclined surfaces of the tool. This produces the pressure necessary for an intensive spreading effect in the adjacent mixture by the lateral deflection of the adjacent particles in relation to the drive direction of the tools. As a result thereof, the adjacent mixture is set in motion and moves to the side, with however the pressure in the mixture being maintained by an appropriate length of the inclined sliding surfaces on the tool also during this deflected movement.

Therefore, intensive spreading of the glue by friction of chip against chip requires hard sliding of the chip material against the tool so that such tools shaped in their working section e.g. like a plowshare are subject to considerable heating up due to friction, and generally have to be cooled by special cooling systems.

While with such tools, a uniform gluing of chips or similar material can be achieved in an optimum way so that using this mixture, chip boards of first-class quality can be produced, it has been shown that fiber boards manufactured using fibers glued in this way, show features which impair quality. Such fiber boards contain a great number of glue inclusions in the form of pockets or spots which become brittle. The felting of the individual fibers in the board desired to achieve maximum strength, is decisively influenced by spherical rolled-up clumps; furthermore a board manufactured by previously used methods contains inclusions of quantities of fiber which have an excessive glue content and are too intensively compressed, and fibers orientated in one direction, these fiber sections being caused by the formation of deposits on parts of the gluing machinery. Such fiber board defects are all the more serious in that such fiber boards due to their homogeneous, felted and layer-free structure can be qualitatively of particularly high quality, and can be especially strong and easily workable. The above-mentioned defects occurring in the finished fiber boards reduce however precisely these decisive fundamental advantages of a fiber board, so that up to now it has frequently not been possible to use such fiber boards, since it was not possible to manufacture then completely free of flaws and also economically.

It is, therefore, an object of the present invention to provide a device which will permit manufacture of essentially defect-free fiber boards or similar articles from fiber material in an economic way.

These and other objects and advantages of the invention will appear more clearly from the following specification, in connection with the accompanying drawings, in which:

FIGS. 3 to 9 show various types of tools designed according to the invention for the gluing apparatus according to FIGS. 1 and 2.

FIG. 11 shows an arrangement of tools on a circular tool carrier.

FIG. 11*a* is a fragmentary section view of circular configuration of structure shown in FIG. 11.

FIG. 11*b* is a fragmentary section view of rectangular configuration of structure shown in FIG. 11.

Figure 12:
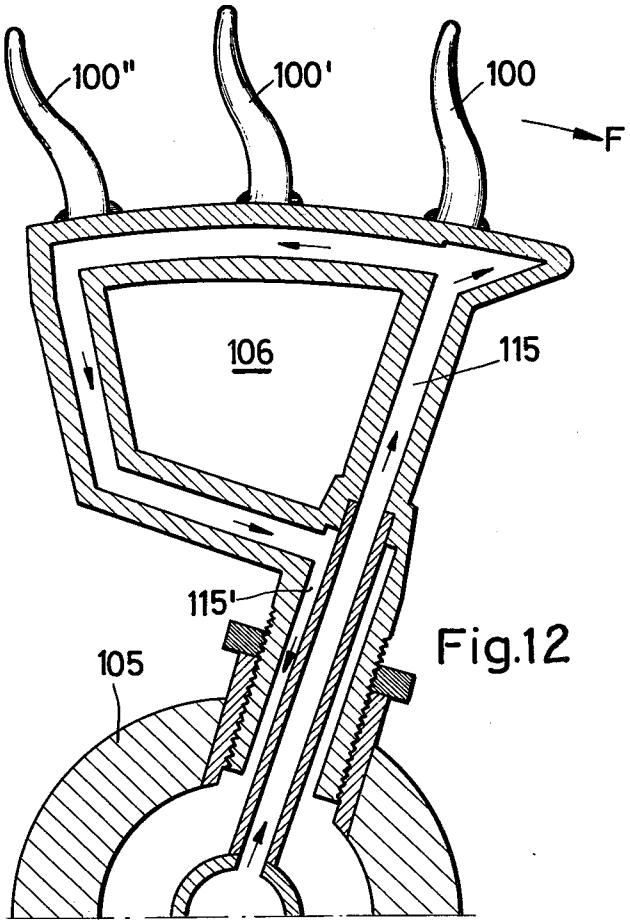
Figure 13:
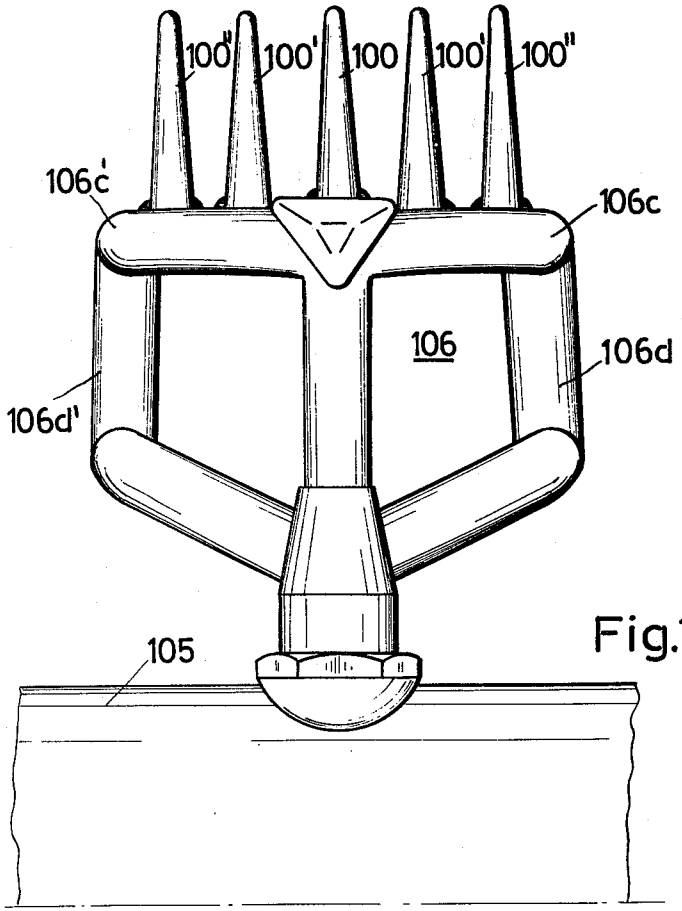

FIG. 12 is a side view of FIG. 13 with tool carrier shown cut out, and also extending in axial direction of mixer shaft.

FIG. 13 shows this tool carrier according to FIG. 12 in projection.

Figure 14:
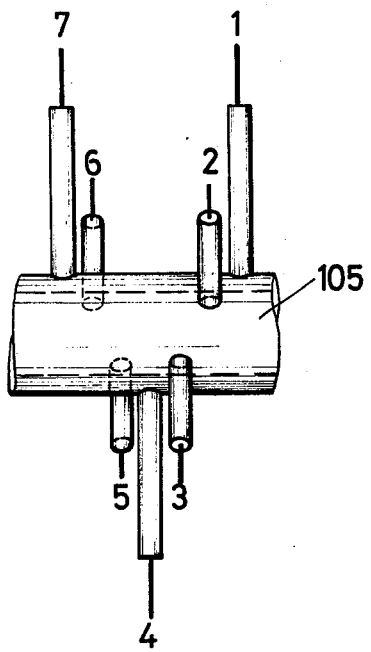
Figure 15:
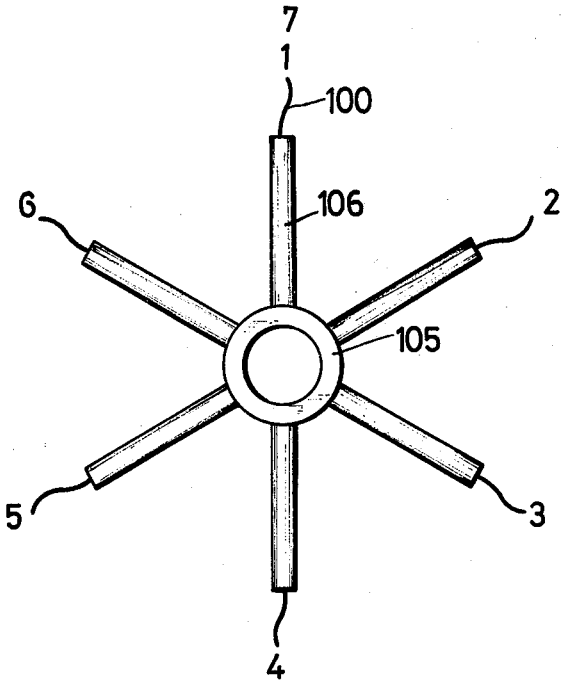

FIGS. 14 and 15 show another example of tool arrangement, this being a helical arrangement on the mixer shaft.

The invention is based on the fact that the glue-fiber clumps are produced by the frictional and spreading effect which is per se favorable for chip gluing, and that previously known machines and tool shapes due to their surface form present to the fiber-glue mixture a sliding and rolling surface which is too large. Due to the hard sliding movement between mixture and tool surfaces necessary to achieve spreading of the glue on glue application, the fibers are rolled and, particularly with a high proportion of glue, the rolled fibers are kept in this position. This results in the formation of spherical rolled-up glue-fiber clumps in which the proportion of glue is frequently too high. On the other hand the glue in the adjacent zones of the material is spread only to a very slight extent, so that glue inclusions result.

It is also an object of the present invention so to modify the process of the initially described type that rolling-up of or pocket-formation in the fiber material after the application of the glue is avoided, and completely uniform distribution of the applied glue to the individual rings of mixture rotating on the wall of the mixing chamber is achieved.

According to the invention this object has been realized by subjecting the mixture of fibers and added glue in driving direction to point-effect or linear-effect pulses.

This avoids hard friction with intensive surface contact as is the case with the known method of distribution of glue over chips, and the mixture is subjected to a movement, with a reduction of the frictional effects produced, which results in a thorough mixing under little pressure. Of course the main direction of the pulses can be varied to conform to respective application requirements, with however an essential component always being in driving direction, in order to maintain the mixing movement of the material. The point- or linear-effect on the mixture rotating in a fiber ring thus avoids not only excessive surface contact such as occurs in a chip material ring rotating in the mixing chamber and thus the frictional phenomena inside the mixture ring known to be disadvantageous, but also results in a fine combing of the material immediately disintegrating any clumps of glue and fiber.

An apparatus according to the invention for the gluing of fibers of particularly materials containing cellulose such as wood, bagasse or similar material has, in conformity also with machines used for chip gluing, a shaft mounted centrally in a drum-shaped mixing chamber and carrying rotating tools into the range of action of which the fibrous mixture moves after glue application, but with the tools, however, having a needle shape in conformity with the invention. The thickness of the needle-shaped tools is less than 5 mm and preferably less than 3 mm, at least in their sections close to the wall, i.e. where the tools act on the rotating fibers, in order to produce the point- or linear-effect pulses.

The tools according to the invention should be as thin as the required strength permits. This thin construction means that the fibers rotating on the wall of the mixing chamber in a ring of mixed material are being continuously given point- or linear-effect mechanical pulses by the tools driven by the drive shaft, the relative lengths of the fibers in relation to one another within the ring of mixture being continuously changed.

To achieve a locally differentiated effect of the needle-shaped tools on the fiber material, the tools can, in a preferred embodiment of the invention, be bent out of radial direction close to the wall. If the tools are thus bent over at their ends close to the walls, in the direction of rotation, the pulses acting on the mixture close to the walls produce an acceleration with a component acting in radial inwards direction, so that the fibrous material close to the wall is deflected over a short distance towards the inside of the mixing chamber, this reducing frictional contact with the mixing chamber walls. By adapting the number of mixing tools and particularly their axial spacing on the mixer shaft which in the preferred embodiment of the invention amounts to less than half and particularly less than one third of the internal diameter of the mixing chamber, with a given circumferential speed of the tools the average overall intensity of the pulses can also be determined as a function of respective application requirements.

Figure 1:
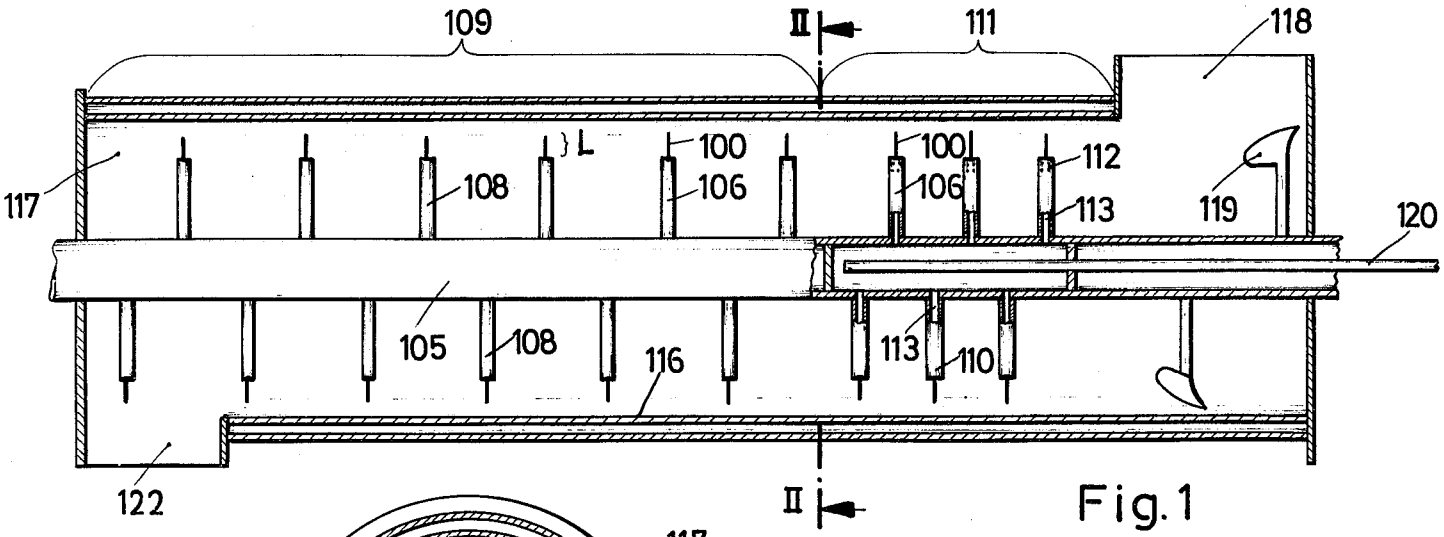
FIG. 1 shows a longitudinal section through a gluing apparatus according to the invention.
Figure 2:
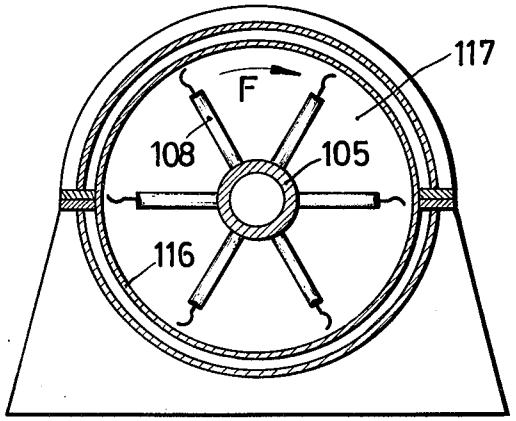
FIG. 2 is a cross section along line II—II of FIG. 1.

Referring now to the drawings in detail, the gluing apparatus shown in simplified form in FIGS. 1 and 2 has a cylindrical mixing chamber 117 with mixer shaft 105 rotating inside said chamber 117. The fibrous mixture passes via feed shaft 118 and is set in rotation by means of drawing tools 119 rotatable on shaft 105, and then passes through gluing zone 111 and then through mixing zone 109, and finally to discharge shaft 122. In gluing zone 111 the gluing tools 110 and in mixing zone 109 the mixing tools 108, driven by mixer shaft 105 rotate at a higher speed so that a ring of fiber material is conveyed along wall 116 of mixing chamber 117. The glue fed into the gluing zone 111 enters via a gluing pipe 120 mounted coaxially with and in mixer shaft 105 and passes via radial glue feed channels 113 mounted in tool carriers 106 of tools 100, e.g. in the form of holes, and is sprayed outwards against the rotating fiber ring directy adjacent to foot 101 of each tool via at least one glue feed channel 112 or several glue feed channels 112', 112'', 112'''. The glue feed apertures can also be designed as slotted channels, e.g. as a slot in the back of each gluing tool 110. Here it is essential that the needle-shaped tools which are relatively thin compared with previously known gluing and mixing tools with a thickness close to the wall of under 5 mm in direction of rotation f of the tools lie in front of the glue outlet channels, so that the liquid glue passes into the loosening zone produced by tools 100 inside the fiber ring and thus penetrates deeply into the ring of fiber material. An advantageous loosening and simultaneous displacement of the individual fibers or bundles of fibers or heaps of fibers within the rotating ring of mixture is produced if tools 100 enter the rotating fiber ring at an angle and are mounted with their tool-base 101 onto the screwed-in tool carrier 106 detachably by means of thread 107 or rigidly by means of weld 107' (see FIG. 8), and are designed so that at least the center line 103 of the tip 108 of tool 100 forms an angle $\alpha$ of less than 90° with the radial 104 passing through tool-base 101. In this way, depending on the given conditions of the type of fiber, length of fiber, rotational speed of rotating fiber ring within the mixing chamber, etc., the tool tip 102, as shown in FIG. 3 can be bent in relation to the radial 104 in such a way that tip 102 in relation to direction of rotation (f) of FIG. 3 has a trailing effect in relation to the radial position of the tool as indicated by the dot-dash line. In this connection it is advisable to give an approximately s-shape bend to tool 100 in such a way that the radial tool-base 101 runs approximately parallel to the point 102 of the tool. Length L of tool 100 must not be smaller than the thickness of the rotating fiber ring in the gluing machine.

In the embodiment shown in FIGS. 4, 5, 6, and 7 the tip 102 of tool 100 in the direction of rotation (F) points forward in relation to the radials 104. The tip 102 is bent into a curve, or it can be bent to a straight-line angle as shown in FIG. 6 in relation to the approximately radial base 101. In the type shown in FIG. 5, the curved section(s) is located only at the tip 102, this curved section(s) passing directly into radial section($s_1$).

All tools have a cross section tapering from tool base 101 to tip 102, i.e. a cross section becoming thinner in this direction. The tapering is preferably gradual, i.e. the taper increases towards the tip. The diameter of the tip of the tool having an essentially circular or oval cross section should not be greater than 7 mm, and should preferably be smaller than 5 mm. It is an essential feature of the invention that the tools bent in the way according to the invention can be arranged in the same way as both gluing tools 110 in the gluing zone 111 and as mixing tools 108 in mixing zone 109. The design of the needle-shaped tools 100 according to the invention with the tips 102 of tools 100 bent over in the direction of rotation has the effect that the tips 102 when engaging in the ring of fiber pull out quantities of fibers from the felted bed of this fiber ring, where due to the curved shape and thus the different speed components occurring in the zone of this curve, they are necessarily moved inwards towards the center of the fiber ring. There they move into layers of the fiber ring with a lower contact pressure or lower density. This advantageous fact can be further improved if the sector of tool 100 on the radially inner side, i.e. towards tool-base 101 is inclined against the direction of rotation. In this case the fiber clumps or bundles of fiber ring layers, in which there is a lower contact pressure and less density, are necessarily forced outwards in thicker layers due to the inclination of at least one section of tool 100, and here they come against the fiber bundles or clumps picked up by the curves of the tools pointing forwards in direction of rotation. In this way a relative displacement of the fiber bundles or clumps is produced as the tool rapidly passes through the fiber ring which results in an intensive evening out and loosening of the fibers in the fiber ring. Such uniform loosening of the fibers in the fiber ring over the complete axial length of the mixing chamber up to fiber outlet 122 is, however, of decisive importance for uniform quality of the fiber boards to be manufactured and in particular for the uniform distribution of the added glue.

It is fundamentally also possible, depending on the type of chip or operation, to have a radial tool form. In this case the unravelling effect described above and thus also a degree of loosening and evening out of the fibers within the rotating fiber ring, but, however, without the required greater relative displacements which are produced due to the curved shape of the tool. The curved shape of the tool according to the invention has in fact the advantage that the relative fiber movements occurring in the zone of the curve of the tool in relation to tool surface prevent fiber bundles or individual fibers from being caught on the tool. In this way the sliding of the fibers from tool 100 is aided by the suction produced behind the tool and in the loosening zone, because in this zone directly behind the tool, fiber pressure is lower and fiber layer density is less. This is also an advantage in that on the surface of the tool, particularly at tip 102, especially in gluing zone 111, liquid lime is sprayed into the loosening area behind tool 100 via a special glue feed duct 113 with glue discharge duct 112, and there are no deposits, since with the form according to the invention the relative movements of the fibers in relation to the tool, the thrust of the fiber clumps pushing inwards or outwards continuously wipe any deposits away from tool 100. This gives a kind of self-cleaning effect on tool 100, since glue deposits are not formed on the tool either in the mixing zone 109 or in the gluing zone 111.

In order to advantageously reinforce this self-cleaning effect, the surface of tool 100 can be ground extremely finely or polished. This further reduces friction between the fibers and the tool shaft.

In particular, if tools 100 are used as gluing tools 110, it is advisable to make tool 100 as a part separate from tool carrier 106. It can be secured by means of thread 107 or by welded joint 107' to tool carrier 106 (FIGS. 3 to 8). It is however also possible that particularly when using the tool as mixing tool 108, to make the latter and tool carrier 106 as a single homogeneous component. This gives the tool even greater stability if this is necessary (FIG. 7). The tool 100 according to the invention can also be used with a gluing apparatus in which the glue is fed from outside through the jacket of the drum.

As already mentioned, when tool 100 is used as a gluing tool 110, there is a glue feed duct 113 in carrier 106 which connects with a glue outlet duct 112 (FIGS. 3 to 8). This glue outlet duct 112 may consist of at least one but preferably several holes advantageously arranged one behind the other 112, 112', 112'', 112''', these holes as shown in the drawing rising backwards at an angle to the fiber ring. Tools 100 have a square connection 121 for easy removal, so that for repairs or for replacement they can easily be taken out of tool carrier 106. Holes 112 can be arranged one behind the other but also adjacent to one another as multiple holes or as approximately radially-arranged slots.

Figure 8:
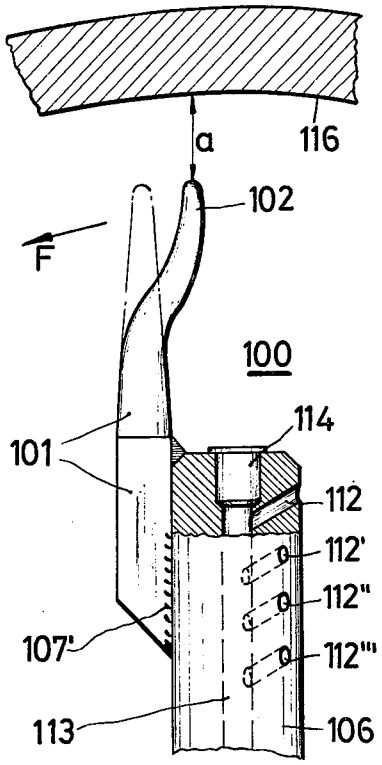

In the embodiment shown in FIG. 8, tool 100 with its base 101 is mounted on the front side of tool carrier 106 in rotational direction (F), connected e.g. by weld 107'. The bend of the tip in this case is outside the radial continuation of hole 113 in such a way that easy accessibility from outside is possible to lock 114 and hole 113.

Figure 9:
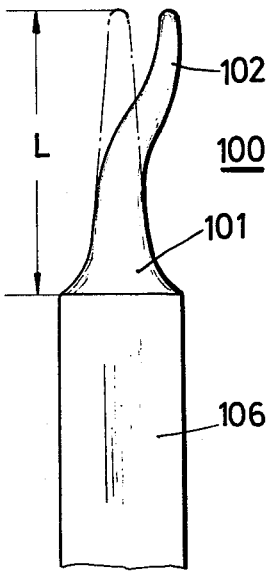
Figure 10:
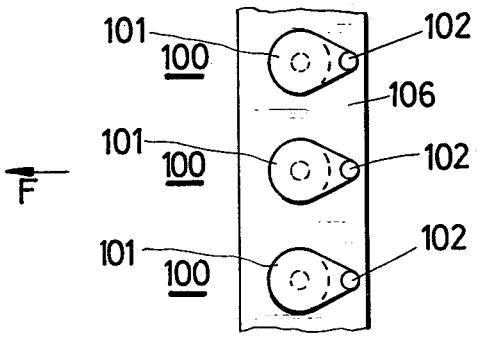
FIG. 10 represents the arrangement of tools according to FIGS. 3 to 9 on a tool carrier extending in axial direction of mixer shaft, top view.

The embodiment shown in FIGS. 10 to 13 of the tools and their carriers according to the invention have the feature in common that tool carrier 106 has a shape deviating from the radial extension, e.g. it has a segmental, annular, circular, paddle, shovel or plow-share shape. FIG. 10 shows a top view schematic diagram of a cutout of a paddle-type tool carrier 106, on which three tools 100 are mounted. tool tip 102 is as illustrated in FIGS. 3, 8, 9 bent away from the direction of rotation (F) in such a way that it lies behind the tool base 101. It is essential that with all tools of this type the e.g. curved bend or other bending of the tip of the tool, i.e. tool tip 102, lies within the vertical plane perpendicular to the axis of rotation, i.e. perpendicular through foot 101 and the axis of tool carrier 106. In special cases, the tool tip could be bent out of this perpendicular plane of rotation. In the embodiment shown in FIG. 11 the tools 100 are mounted on a carrier **106*a* which is annular in shape and which is mounted on mixer shaft 105 by means of spokes 106*b*. This carrier 106*a* and its spokes 106*b* may have any cross section, e.g. circular, oval, or rectangular. This design permits particularly easy cooling of the tools, since a cooling medium can be conducted through the preferably hollow spokes 106*b* and through the hollow rims 106*a* which have cooling ducts 115. In the drawing FIG. 11**, the cooling medium feed is indicated by an arrow (f1) and discharge of the heated cooling medium with an arrow (f2).

Here also tools 100 can be fixed to the rim-type carrier **106*a* either detachably by means of a threaded connection or rigidly by welding. With the rim-type 106*a* with rectangular cross section, there exists the advantageous possibility of being able to mount on the parallel narrow sides further towards the center tools 100 with laterally offset tool tips 102**.

FIGS. 12 and 13 show, similarly to FIG. 10, a tool carrier in which sections **106*c* and 106*c'* are provided extending in axial direction in relation to mixer shaft 105. With this arrangement a number of tools 100, 100', 100'', may be mounted on the mixer shaft 105 by means of a tool carrier 106. The arrangement of the tools is preferably symmetrical to the central axis of rotation of the tool, with, according to FIGS. 12 and 13 the center tool 100 being advanced relative to its neighbor's tools 100', 100''** in the direction of rotation (F).

With this design also the tool shaped in the manner of a plow-share or a paddle may have a cooling medium e.g. water passing through it via cooling medium ducts 115, with the cooling medium feed ducts 115 possibly surrounded coaxially by the cooling medium discharge duct 115'. The sections 106c and 106c' extending axially to the mixer shaft 105 may be set back in relation to direction of rotation (F) and can be connected at their rear by downward sections 106d, 106d' to the cooling medium discharge duct 115' in the base of the carrier.

A further advantageous embodiment of the apparatus according to the invention is characterized in that depending on the consistency and/or length of the fibers to be processed in the ring of fiber material the radial distance shown in FIG. 8 between the end of tip 102 and the inner wall 116 of the mixer drum may be varied. According to the invention, this distance should be between 8 and 16 mm, preferably between 12 and 15 mm, with fibers which tend to easily felt and clump together like cottonwool, as is the case e.g. with long fibers. With all other fibers, particularly with short fibers, this distance should be smaller, i.e. between 3 to 8 mm, preferably 4 to 6 mm. This spacing according to the invention in particular reinforces the above mentioned self-cleaning effect and the required relative movement of the fibers between the individual radial layers of the fiber ring necessary for this, and prevents adhering or catching of the fibers on the tools.

A further essential feature consists in that by the varying axial and radial arrangements of the tools 100 according to the invention, in the gluing zone 111 and the mixing zone 109 the conveying effect and output of the tools can be influenced in relation to the ring of fiber material. With the preferred embodiment according to the invention the needle-shaped thin tips of the tools, less than 5 mm thick, and the tools themselves with their carriers 106, are offset like a spiral around the circumference of mixer shaft 105. Such an arrangement is shown schematically in FIGS. 15, 15a. This spiral arrangement of the tools according to the invention gives a continuous conveying effect which can be adjusted to the particular fiber material as a function of spiral pitch, in such a way that the described positioning of the fiber heaps within the fiber material ring on rotation of shaft 105 can be passed on to the respective following tool in a precisely determined sequence.

In a preferred embodiment, the tools 110 mounted in gluing zone 111, are offset in relation to one another in the form of a single helix, while the tools 108 located in mixing zone 109 are offset in relation to one another in the form of a double or multiple helix in order to reinforce the mechanical action while maintaining an overall constant flow of material or an overall constant flow rate. The fiber material after contact with the glue rapidly changes its conveying properties important for the gluing process in a negative sense, evident in greater inertia (increased adhesiveness). The advantageous effect on the fiber or the fiber heaps of the helical arrangement of tools in mixing zone 109 is reinforced in relation to the gluing zone, which surprisingly results in a considerable improvement of the desired homogeneity of the fibers to be discharged, and also in trouble-free operation with uniform fiber flow, and it also prevents interruptions in throughput of the gluing machinery. Thus, outstandingly optimum results have been achieved if over an axial area of mixer shaft 105 measuring about 50 to 100 mm, preferably 65 mm about 4 to 10, preferably 6, tools 100 are mounted offset to one another at an equal angular distance (FIGS. 14, 15). Furthermore optimum results, independent of the size of the internal diameter of the mixing drum, are achieved if in conformity with the invention the ascending pitch of the helix described by the tools in their arrangement, measured at tips 102 of tools 100, amounts to about 1° to 8°, preferably however 1.5° to 4°. By means of such an arrangement as is shown schematically in FIGS. 14 and 15, independently of the size of the mixing chamber the individual fiber material portions, which are caught up by the tips 102 in their pulse-like effect on the fiber material ring, are passed on to the next tool with approximately identical circumferential speed independent of drum diameter with respectively uniform throw-off speed and throw-off direction, and thus arrive in the direct field of action of the next tool and do not move unprocessed between successive tools without the necessary following impulse forwards. This initial loosening and evening-out stage takes place in gluing zone 111, where due to the uneven arrangement of the fiber heaps in relation to one another in the fiber material ring the individual helically-arranged tools collect correspondingly large heaps and move them on to the next tool. This determines the preferred arrangement of the tools in the form of a single helix within this section. After they have passed through this section 111 the fibers within the rotating ring of material are already unfelted and unravelled to such an extent that although there is no great difference with respect to the density of the fiber portions in relation to one another, as gluing continues however the flow properties of the fibers are reduced by greater adhesiveness. Thus in mixing zone 109 together with finer loosening and working of the fibers in the fiber material ring stronger conveying pulses are required, these being supplied by the double or multiple helix arrangement of tools 100 according to the invention, in this mixing zone. Due to the double or multiple helix arrangement a correspondingly higher number of impelling pulses are transmitted to the individual fibers and thus to the fiber material ring, and this reinforces the advantageous effect by improving the loosening and uniformity of the individual fibers in the fiber ring while contributing to the keeping constant of the total flow rate.

It is, of course, to be understood that the present invention is, by no means, limited to the specific showing in the drawings, but also comprises any modifications within the scope of the appended claims.

What is claimed is:

1. An apparatus for applying adhesive to cellulose wood fibrous material circulating in a ring configuration comprising: a generally horizontally extending cylindrical member with an inlet at the top near one end and an outlet at the bottom near the other end, a shaft rotatably mounted on the axis of said cylindrical member and extending the length of said member, material engaging means carried by said shaft adjacent said inlet to rotate and advance said material in said cylindrical member, and mixing tool means secured to said shaft and spaced downstream from said material engaging means along the remainder of the shaft in circumferentially and axially distributed relation and extending substantially radially from said shaft toward the inner surface of said cylindrical member, said cylindrical member including an adhesive application zone and a mixing zone, said mixing tool means being in both said zones, said mixing tool means in said adhesive application zone including tool means each having a radially inner foot end attached to said shaft, adhesive applying means leading radially outwardly of said shaft from said inner foot end through said tool means and having a discharge bore through the outer surface of said tool means for discharging adhesive from said shaft onto said fibrous material, and a radially outer tip means beyond said discharge bore tapering to an outer tip, said mixing tool means in said mixing zone comprising a carrier portion fixed to the shaft and tip means mounted thereon, and cooling fluid passage means in said carrier portion, said carrier portion being in the form of an annular channel member concentric with said shaft, spokes connecting said channel member to said shaft, and means for supplying cooling fluid from said shaft through one of said spokes to said channel member and back to said shaft through another of said spokes, said shaft having a cooling fluid supplying passage connected to said one spoke and a cooling fluid return channel connected to said other spoke.

2. An apparatus according to claim 1, in which the tip means of each mixing tool means in both said zones is inclined rearwardly relative to the direction of rotation of the shaft.

3. An apparatus according to claim 1, in which the tip means of each mixing tool means in both said zones is inclined forwardly relative to the direction of rotation of the shaft.

4. An apparatus according to claim 1, in which the tip means of each mixing tool means in both said zones is curved relative to the remainder of the mixing tool means and merges into the remainder of the mixing tool means.

5. An apparatus according to claim 1, in which the radial distance from the radially outer ends of the mixing tool means in both said zones to the inner surface of said cylindrical member varies from about 8 millimeters to 16 millimeters for long fibers to about 3 millimeters for short fibers.

6. An apparatus according to claim 1, in which said cylindrical member includes an adhesive application zone along that portion of the length thereof nearest the inlet and a mixing zone extending along the remainder of the length thereof, and wherein each mixing tool means in both said zones in the region of said tip means has a maximum thickness on the order of about 5 millimeters.

7. An apparatus according to claim 6 in which said adhesive applying means includes a passage in each tool means through which adhesive is supplied to the fibrous material, bores on the rearward side of the tool means leading into said passage, and a plug closing the outer end of the passage.

8. An apparatus according to claim 6 in which said tool means in said adhesive application zone comprise tool means disposed in a helical path about said shaft.

9. An apparatus according to claim 6, in which the tool means through which adhesive is supplied include a channel therein and bores leading from the channel to the outer surface of the tool means.

10. An apparatus according to claim 9, in which said bores are distributed peripherally along the tool means.

11. An apparatus according to claim 1, in which each tool means in said application zone is a single integral element.

12. An apparatus according to claim 1, in which said tool means in said mixing zone comprise a plurality of tool tip portions connected to said carrier portion and protruding radially therefrom.

13. An apparatus according to claim 12, in which each said tip portion is threadedly connected to said carrier portion.

14. An apparatus according to claim 15 in which the radially outer tip means of each tool means in the adhesive application zone has a maximum diameter smaller than 5 mm. and wherein a foot portion extends between said radially inner foot end and said radially outer tip means said foot portion having a glue passage therein which terminates at a location radially inwardly of said radially outer tip means.

* * * * *

UNITED STATES PATENT OFFICE

CERTIFICATE OF CORRECTION

Patent No. 4143975 Dated 13 March 1979

Inventor(s) Wilhelm Lödige et al

It is certified that error appears in the above-identified patent and that said Letters Patent are hereby corrected as shown below:

[73] Assignees: Wilhelm Lödige, Fritz Lödige, and Josef Lücke, all of Paderborn, Germany; part interest to each.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*